US007479100B2

(12) United States Patent
Toth

(10) Patent No.: US 7,479,100 B2
(45) Date of Patent: Jan. 20, 2009

(54) CUSHIONING CONVERSION SYSTEM AND METHOD

(75) Inventor: Zsolt Toth, Tuckahoe, NY (US)

(73) Assignee: Zsolt Design Engineering, Inc., Tuckahoe, NY (US)

( * ) Notice: Subject to any disclaimer, the term of this patent is extended or adjusted under 35 U.S.C. 154(b) by 0 days.

(21) Appl. No.: 11/652,610

(22) Filed: Jan. 12, 2007

(65) Prior Publication Data

US 2007/0117705 A1 May 24, 2007

Related U.S. Application Data

(60) Division of application No. 10/899,149, filed on Jul. 27, 2004, now Pat. No. 7,172,548, which is a continuation-in-part of application No. 10/647,252, filed on Aug. 26, 2003, now Pat. No. 7,163,503, which is a division of application No. 10/208,772, filed on Aug. 1, 2002, now Pat. No. 6,673,001, which is a continuation-in-part of application No. 09/819,998, filed on Mar. 29, 2001, now Pat. No. 6,503,182.

(51) Int. Cl.
*B31B 1/02* (2006.01)

(52) U.S. Cl. ..... 493/464; 493/395; 493/967

(58) Field of Classification Search ..... 493/464, 493/395, 967

See application file for complete search history.

(56) References Cited

U.S. PATENT DOCUMENTS

| | | | | | |
|---|---|---|---|---|---|
| 673,312 | A | | 4/1901 | Bechman | |
| 803,972 | A | | 11/1905 | Bechman | |
| 1,739,328 | A | | 12/1929 | Roesen | |
| 2,197,782 | A | * | 4/1940 | Barbieri | 493/74 |
| 2,593,157 | A | * | 4/1952 | Lorig | 226/192 |
| 2,593,158 | A | * | 4/1952 | Lorig | 226/192 |
| 2,686,590 | A | * | 8/1954 | Sloane | 198/824 |
| 2,688,216 | A | * | 9/1954 | Lorig et al. | 451/302 |
| 2,706,625 | A | * | 4/1955 | Lorig | 226/195 |
| 2,786,399 | A | | 3/1957 | Mason et al. | |
| 2,797,088 | A | * | 6/1957 | Lorig | 226/189 |
| 2,817,940 | A | * | 12/1957 | Lorig | 226/192 |
| 3,191,289 | A | * | 6/1965 | Fleischer | 228/130 |
| 3,473,291 | A | | 10/1969 | Raumond et al. | |
| 3,603,216 | A | | 9/1971 | Johnson | |
| 3,799,039 | A | | 3/1974 | Johnson | |
| 4,052,920 | A | | 10/1977 | Dixon | |
| 4,102,513 | A | | 7/1978 | Guard | |

(Continued)

*Primary Examiner*—Hemant M Desai
(74) *Attorney, Agent, or Firm*—Antonelli, Terry, Stout & Kraus, LLP.

(57) ABSTRACT

A system for creating and dispensing cushioning dunnage includes a plurality of material shaping members to convert a sheet stock material into a continuous strip of cushioning product. The shaping members include a constant-entry roller assembly having at least two tapered rollers supported end to end for rotation about respective ones of first and second axes arranged at an obtuse angle whose aspect faces a circumferential side of the rollers that first engages sheet stock material traveling over the rollers from a supply roll of the material. The tapered rollers present material engaging surfaces on an imaginary material conversion line transverse to the travel direction of the material where the material first engages the rollers for more precise and consistent control of alignment of the stock material. The roller assembly has free ends over which the sheet stock material can be folded to reduce the width of the material traveling over the rollers.

1 Claim, 14 Drawing Sheets

U.S. PATENT DOCUMENTS

| | | | | |
|---|---|---|---|---|
| 4,355,493 | A | | 10/1982 | Ellert |
| 4,750,896 | A | | 6/1988 | Komaransky et al. |
| 4,819,929 | A | * | 4/1989 | Stobb ..... 271/177 |
| 4,999,968 | A | | 3/1991 | Davis |
| 5,076,555 | A | | 12/1991 | Bunch, Jr. |
| 5,131,903 | A | | 7/1992 | Levine et al. |
| 5,203,761 | A | | 4/1993 | Reichental et al. |
| 5,643,647 | A | | 7/1997 | Wischusen, III |
| 5,730,696 | A | | 3/1998 | Simmons |
| 5,749,539 | A | | 5/1998 | Ratzel et al. |
| 5,755,656 | A | | 5/1998 | Beierlorzer |
| 5,785,639 | A | | 7/1998 | Simmons |
| 5,881,620 | A | | 3/1999 | Smithwick, Jr. et al. |
| 5,902,223 | A | | 5/1999 | Simmons |
| 5,938,580 | A | | 8/1999 | Siekmann |
| 6,033,353 | A | | 3/2000 | Lencoski et al. |
| 6,146,321 | A | | 11/2000 | Simmons |
| 6,179,765 | B1 | | 1/2001 | Toth |
| 6,200,251 | B1 | | 3/2001 | Harding et al. |
| 6,217,501 | B1 | | 4/2001 | Simmons et al. |
| 6,240,705 | B1 | | 6/2001 | Simmons et al. |
| 6,277,459 | B1 | | 8/2001 | Lencoski et al. |
| 6,471,154 | B1 | | 10/2002 | Toth |
| 6,503,182 | B2 | | 1/2003 | Toth |
| 6,673,001 | B2 | | 1/2004 | Toth |
| 6,758,801 | B2 | | 7/2004 | Harding et al. |
| 6,910,997 | B1 | | 6/2005 | Yampolsky et al. |
| 7,022,060 | B2 | | 4/2006 | Toth |
| 2004/0043883 | A1 | | 3/2004 | Toth |

* cited by examiner

CUSHIONING CONVERSION SYSTEM AND METHOD

RELATED APPLICATIONS

This application is a divisional application of U.S. Ser. No. 10/899,149, filed Jul. 27, 2004, now US. Pat. No. 7,172,548 issued Feb. 6, 2007; which is a continuation-in-part of U.S. Ser. No. 10/647,252 filed Aug. 26, 2003, now U.S. Pat. No. 7,163,503 issued Jan. 16, 2007 which is a Divisional of U.S. Ser. No. 10/208,772, filed Aug. 1, 2002, now U.S. Pat. No. 6,673,001 issued Jan. 6, 2004 which is a Continuation-in-Part of U.S. application Ser. No. 09/819,998, filed Mar. 29, 2001, now U.S. Pat. No. 6,503,182 issued Jan. 7, 2003, which are hereby incorporated by reference. Commonly owned U.S. patent application Ser. No. 09/819,640, filed Mar. 29, 2001, and now U.S. Pat. No. 6,471,154 issued Oct. 29, 2002, for Automatic Roll Tensioner and Material Dispensing System Using the Same, is also hereby incorporated by reference.

TECHNICAL FIELD

The invention relates to a system and method employing the same for converting a sheet stock material into a three-dimensional cushioning product as the material travels through the system. The cushioning product is useful as void fill and cushioning dunnage in the packaging industry when shipping products in boxes, for example.

BACKGROUND

Cushioning dunnage is used as a protective packaging material when shipping an item in a container. The dunnage fills any voids and/or cushions the item in the container during shipping. Typical materials for forming cushioning dunnage include paper and plastic. Relatively complicated machines and methods are known for producing cushioning dunnage comprising resilient pillow-like strips from rolls of stock material. One such known machine is disclosed in U.S. Pat. No. 5,785,639. The known machines are disadvantageous in that they are suitable primarily for larger-scale productions and they are relatively expensive. There has long been a need in the packaging industry for a small and inexpensive device that creates and dispenses paper or other material for use as void fill and cushioning when shipping products in boxes or other containers. The apparatus and system disclosed in Applicant's above-identified related applications addressed this need.

The systems disclosed in the aforementioned related applications include a conversion assembly comprising a convex material shaping roller over which sheet stock material is drawn, and two pairs of spaced, parallel input rollers following the shaping roller through which the stock material is pulled by feed rollers to convert the sheet stock material into a three-dimensional cushioning product. In one disclosed embodiment the conversion involves reducing the width of the material so that random convolutions are formed in the material across the width of the material without folding back the edges of the material. It has been found that the convex material shaping roller of the previously disclosed conversion assembly introduces friction to the traveling stock material. This friction is caused by the convex shaping roller being rotated by the passing stock material contacting the larger diameter center portion of the roller. The smaller diameter lateral end surfaces of the roller then move more slowly than the traveling stock material to cause friction when sliding contact is made between these end surfaces and the stock material.

Applicant has attempted to reduce this friction by using a conversion assembly having a segmented convex roller assembly formed of a plurality of coaxial, independently rotatable rollers 9A, 9B and 9C as shown in FIG. 17, in place of a single convex shaping roller. Friction at the outer edges of the material is minimized with this arrangement because each material shaping roller of the convex roller assembly is free to rotate at a different speed than the adjacent roller as the rollers are engaged by the traveling stock material. However, there remains a need for a material shaping structure for a conversion assembly in a cushioning conversion system which provides more precise and consistent control of alignment of the longitudinal center line of the sheet stock material with the material shaping structure during conversion as the material travels through the conversion assembly of the system.

SUMMARY

The present invention addresses this need in providing an improved compact system for creating and dispensing cushioning dunnage. The system is capable of meeting the needs of both ends of the customer spectrum. Namely, the compact system of the invention is affordable and practical for a customer whose packing needs can be met with a single unit that does not take up a lot of space. The system can also serve the needs of customers with high-speed and high-volume production lines having multiple, stand alone packing stations and/or centralized packing stations. Further, the system affords improved control of the alignment of the longitudinal center of the sheet stock material with the center line of the material shaping structure during conversion as the material travels through conversion assembly of the system.

A cushioning conversion system of the present invention comprises a conversion assembly to convert a sheet stock material into a three-dimensional cushioning product as the material travels therethrough in a downstream direction and a stock supply assembly upstream of the conversion assembly to supply sheet stock material to the conversion assembly. The conversion assembly in a disclosed embodiment of the invention includes a constant-entry roller assembly for engaging and shaping sheet material traveling from the stock supply assembly. The roller assembly includes at least two tapered rollers supported for a rotation about respective ones of first and second axes arranged at an obtuse angle whose aspect faces a circumferential side of the rollers that first engages stock material traveling over the rollers. The tapered rollers present on said circumferential side stock material engaging surfaces on an imaginary material conversion line transverse to the downstream direction of the travel of the sheet stock material.

The stock material engaging surfaces on the imaginary material conversion line are preferably located where the stock material first engages the first and second rollers. The longitudinal center line of the sheet stock material in the example embodiment is aligned with a center line of the roller assembly. It has been found that this alignment is precisely and consistently controlled by the stock material engaging surfaces on the imaginary material conversion line, while the roller assembly is effective to redirect the travel direction and reduce the width of the sheet stock material traveling over the assembly.

A method of producing cushioning product according to the invention comprises drawing sheet stock material from a supply of sheet stock material through a conversion assembly employing the roller assembly of the invention to convert the sheet stock material into a three-dimensional cushioning product as the material travels therethrough. In an example embodiment the roller assembly is used to redirect and shape the traveling sheet stock material with the plurality of tapered rollers presenting stock material engaging surfaces on an imaginary conversion line transverse to a direction of travel of the material at a location where the material first engages the tapered rollers. The roller assembly serves as a constant-entry roller assembly for the sheet material from a stock supply assembly in the example embodiment.

These and other features and advantages of the present invention will become more apparent from the following description when taken in connection with the accompanying drawings which show, for purposes of illustration only, several example embodiments in accordance with the present invention.

BRIEF DESCRIPTION OF DRAWINGS

The following represents brief descriptions of the drawings, wherein.

DETAILED DESCRIPTION

Figure 1:
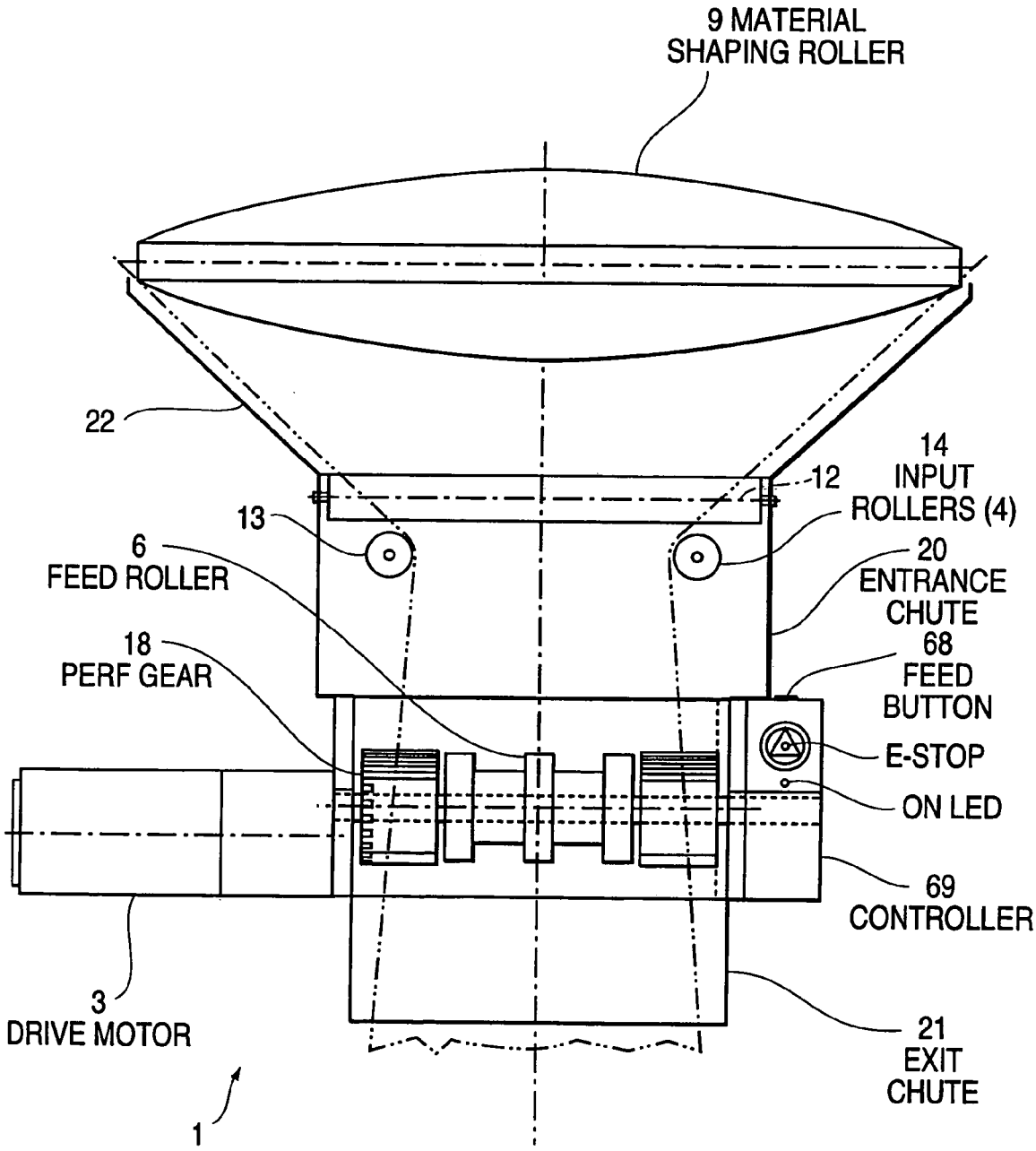
FIG. 1 is a front side view of a compact apparatus according to Applicant's above-referenced prior related applications for creating and dispensing material for use as void fill and cushioning dunnage, for which the present invention is an improvement.
Figure 2:
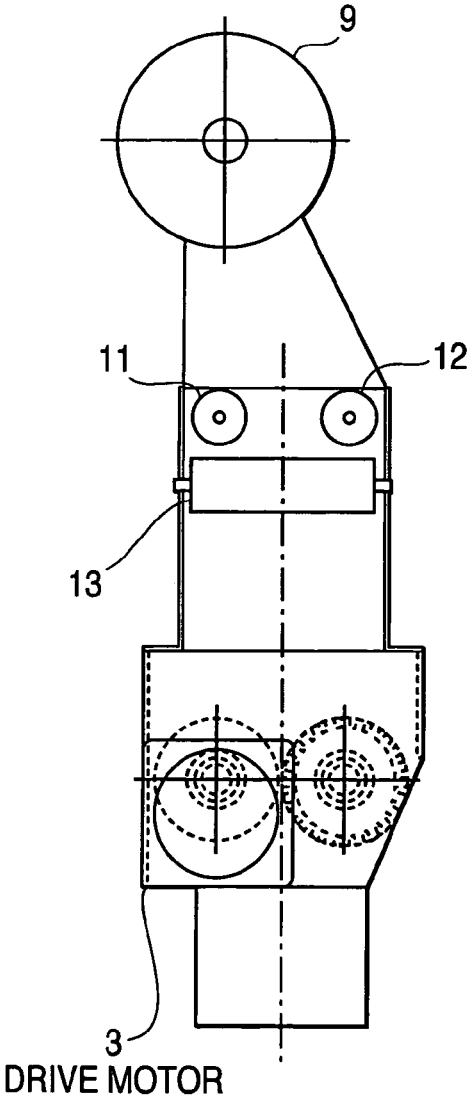
FIG. 2 is a left side view of the compact apparatus of FIG. 1.
Figure 3:
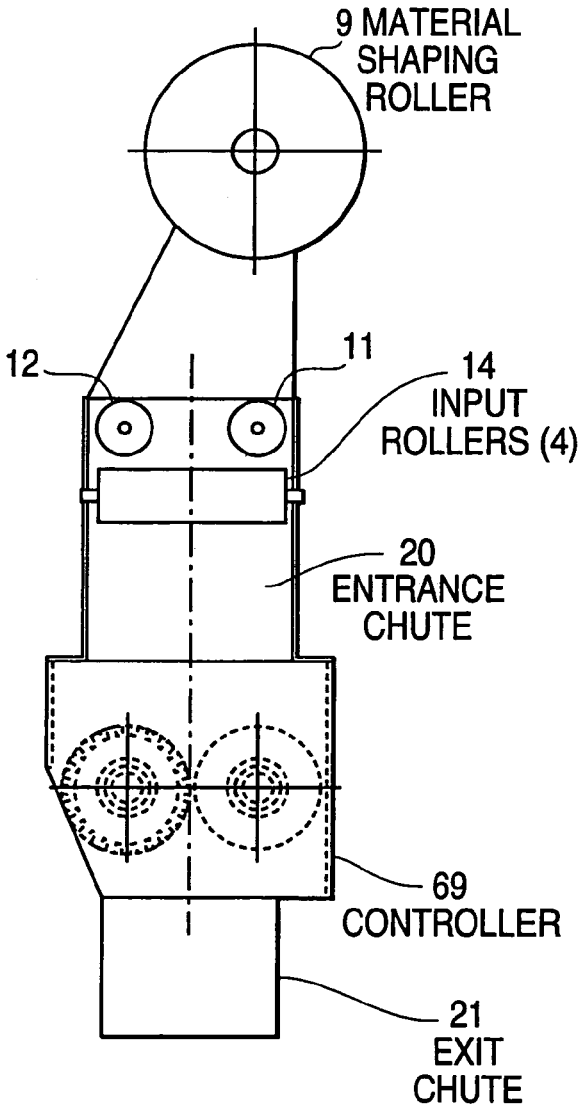
FIG. 3 is a right side view of the compact apparatus of FIG. 1.

Referring now to the drawings, a compact apparatus 1 of the aforementioned related applications for which the present invention is an improvement, is shown in FIGS. 1-6. The apparatus 1 is for creating and dispensing material for use as a void fill and cushioning dunnage. The apparatus 1 is a relatively small, integral unit capable of being mounted on a stand, for example, floor stand 2 in FIG. 6. The apparatus 1 comprises a motor 3 and a material feeding arrangement 4, FIG. 4, driven by the motor for pulling material from a supply of material, e.g., a material roll 5 in FIG. 6, and feeding it through the apparatus.

Figure 4:
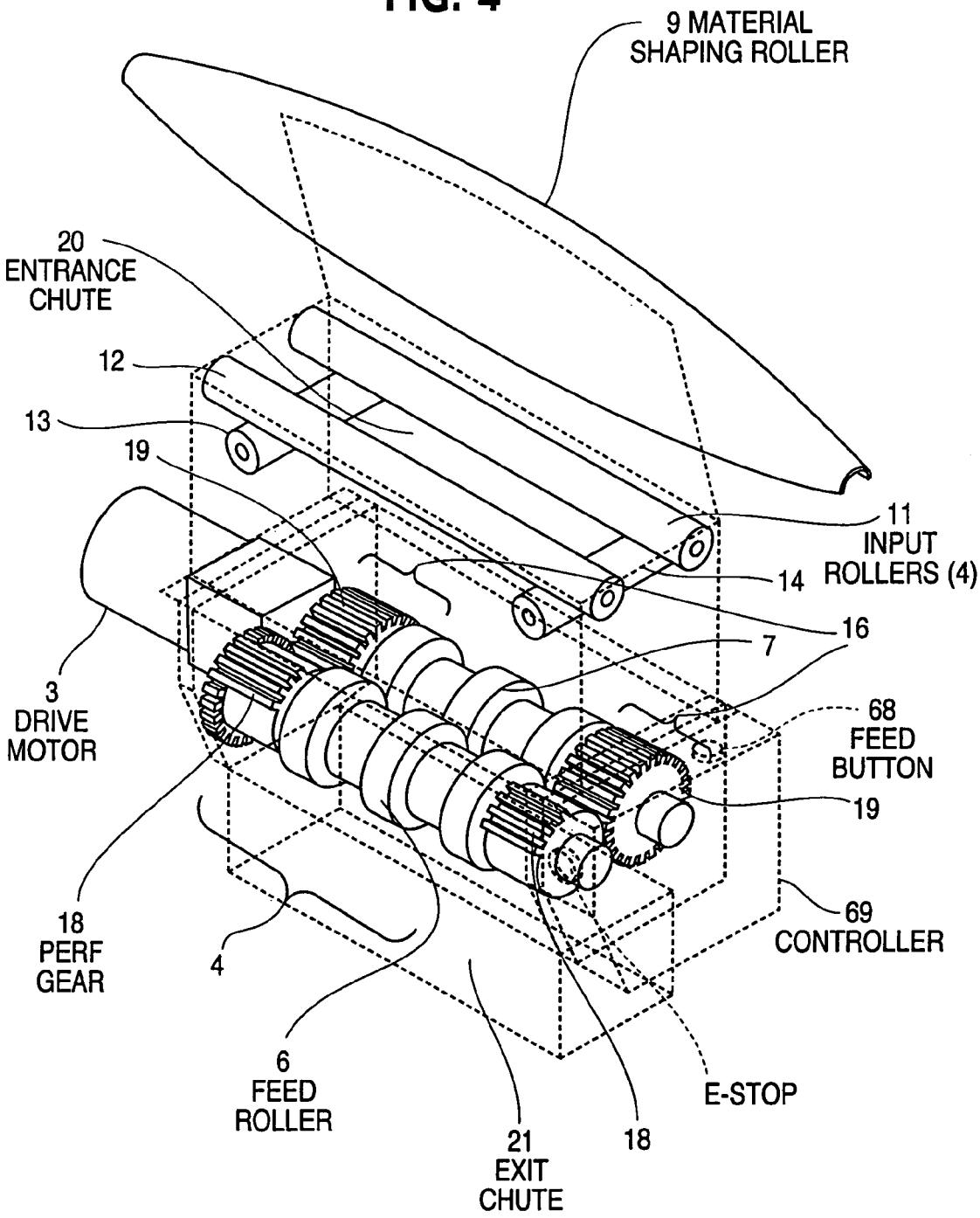
FIG. 4 is a schematic drawing of functional components of the compact apparatus of FIGS. 1-3 more clearly showing the components.
Figure 5:
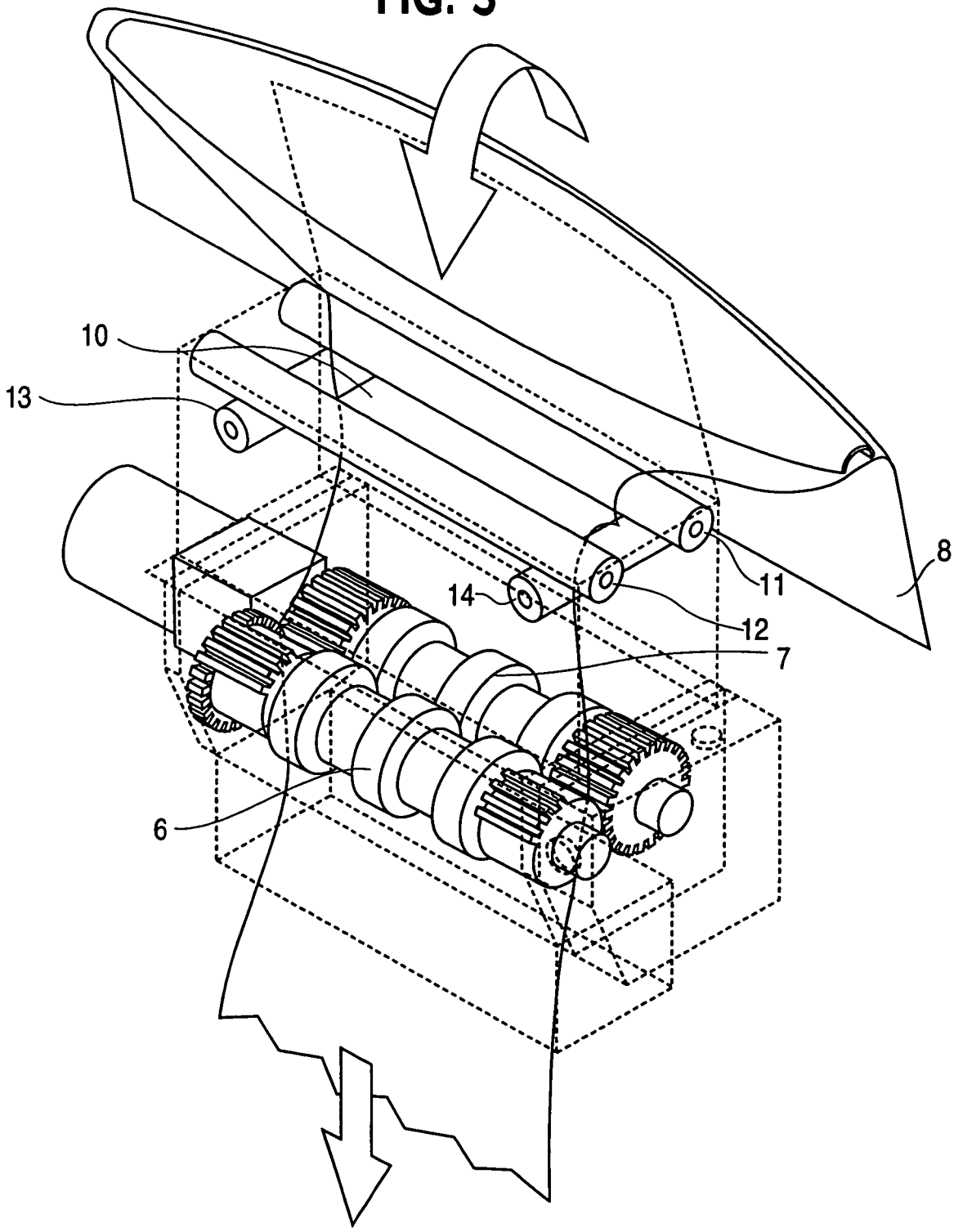
FIG. 5 is a schematic drawing like FIG. 4 showing the apparatus functional components in relation to a paper material being pulled into the apparatus from a supply roll of the paper and fed through the apparatus while being converted into a cushioning product.
Figure 7A:
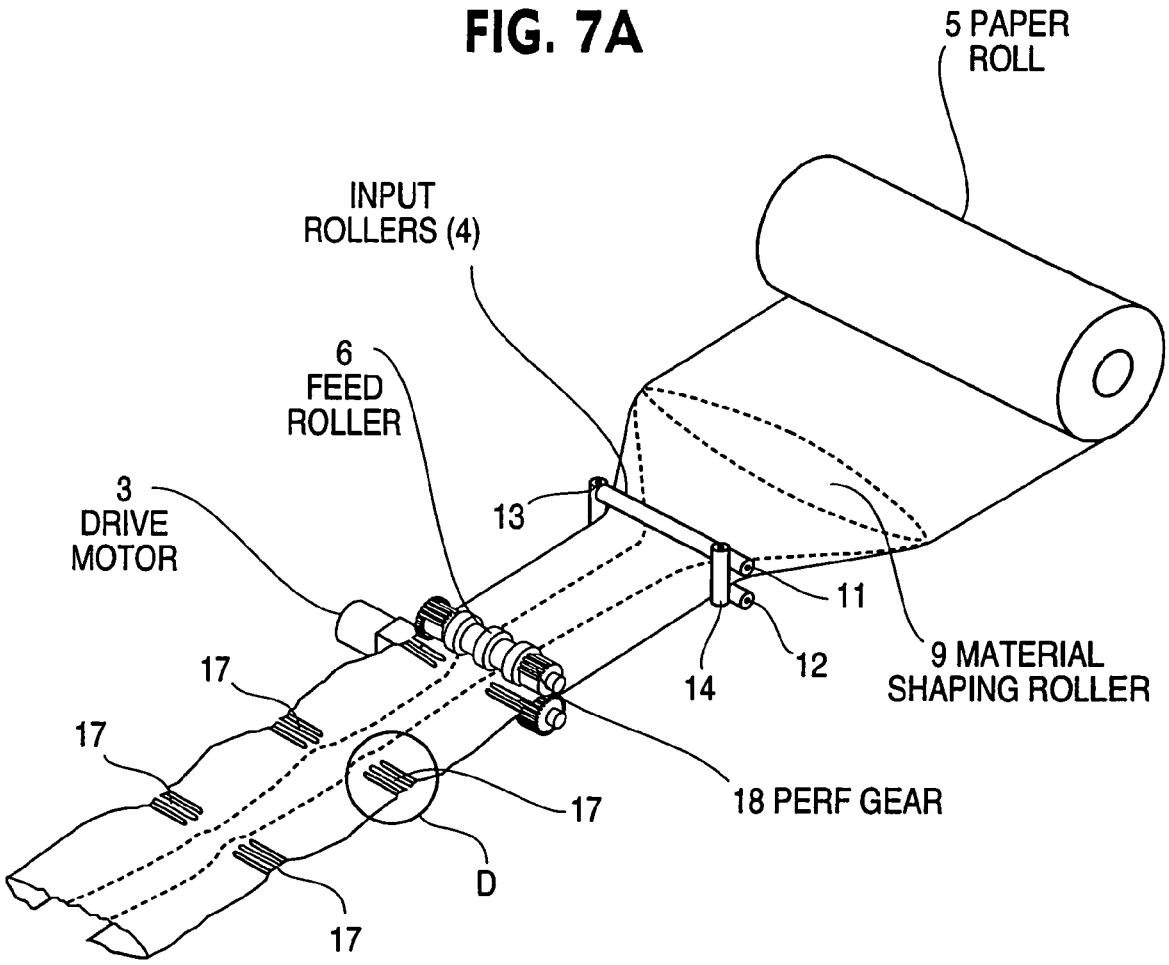
FIG. 7A is a view similar to FIG. 5 but showing more details of the pillow-like product formed by the apparatus with spaced perforations along the length of the product enabling an operator to tear off in a predictable way a desired length of the material from the continuous strip dispensed from the apparatus.
Figure 7B:
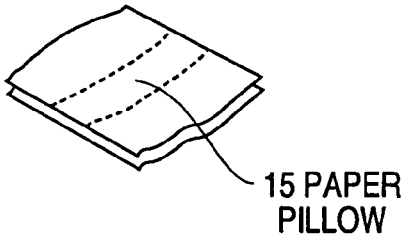
FIG. 7B is a perspective view from above and to one side of a paper pillow which has been ripped from the free end of the continuous cushioning product shown in FIG. 7A.
Figure 7C:
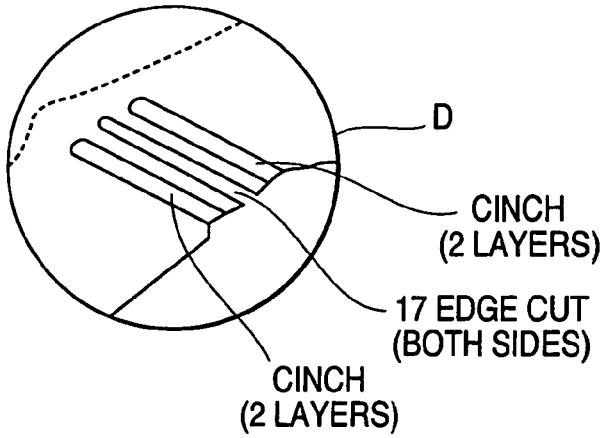
FIG. 7C is an enlarged view of the portion of the cushioning product within the circle D in FIG. 7A, illustrating a perforated area along one edge of the cushioning product.

The material feeding arrangement 4 comprises cooperating feed rollers 6 and 7, see FIG. 4, between which the material 8, paper for example, is fed as depicted in FIG. 5. A plurality of material shaping members upstream of the material feeding arrangement 4 shape the material 8 into a continuous strip of cushioning product as the material is fed through the apparatus 1. The material shaping members include a convex material shaping roller 9 over which the material 8 is drawn by the feed rollers 6 and 7. An input opening 10 for the material 8 downstream of the convex roller 9 is defined by first and second pairs of spaced, parallel rollers 11, 12 and 13, 14. The second pair of rollers 13, 14 extend in a direction transverse to that of the first pair of rollers 11, 12. When the material 8 is drawn over the convex roller 9, the lateral edges of the material are directed in a first direction over the convex surface of the roller 9. Continued movement of the material 9 through the input opening 10 directs the lateral edges of the material 8 in a second direction such that the edges are folded back on the material for forming a continuous strip of cushioning product. More particularly, as shown in FIGS. 7A, 7B and 7C, the convex roller 9 and two pairs of rollers 11, 12 and 13, 14 constitute a conversion assembly through which the paper from the roll 5 is pulled by the feed rollers 6 and 7 to fold and form the paper into pillow-like shapes for use as cushioning dunnage, see paper pillow 15 in FIG. 7B.

The compact apparatus 1 further comprises a perforator 16 driven by the motor 3 for perforating paper material 8 at spaced locations 17 along the length of the material as the material is fed through the apparatus. The line of perforations 17 on each side of the material are edge cuts made by cooperating perforation gears 18 and 19 between which the material is fed. The perforation gears 18 and 19 are arranged coaxial with the feed rollers 6 and 7 on each side of the material being fed. When the pillow-like shaped material is dispensed from the compact apparatus 1, an operator can rip from the apparatus a desired length of cushioning product, such as pillow 15 in FIG. 7B, because of the spaced perforations 17 in the material.

An input chute 20 and an output chute 21 of the apparatus 1 guide the material 8 on respective sides of the material feeding arrangement 4. The input and output chutes, convex material shaping roller 9, input rollers 11, 12 and 13, 14 and other components of the apparatus are mounted as a unit on the supporting frame 22 of the apparatus. The compact apparatus 1 is in the form of a pivotal head which is mounted on the floor stand 2, FIG. 6, for multi-directional pivoting for ease of loading paper material. Different positions for the pivotal head 1 on the floor stand 2 are shown in dashed lines in FIG. 6. It is noted that the size of the input opening 10 delimited by the roller pairs 11, 12 and 13, 14 is small enough to preclude an operator's hand from being inserted through the input opening for operator safety.

Figure 6:
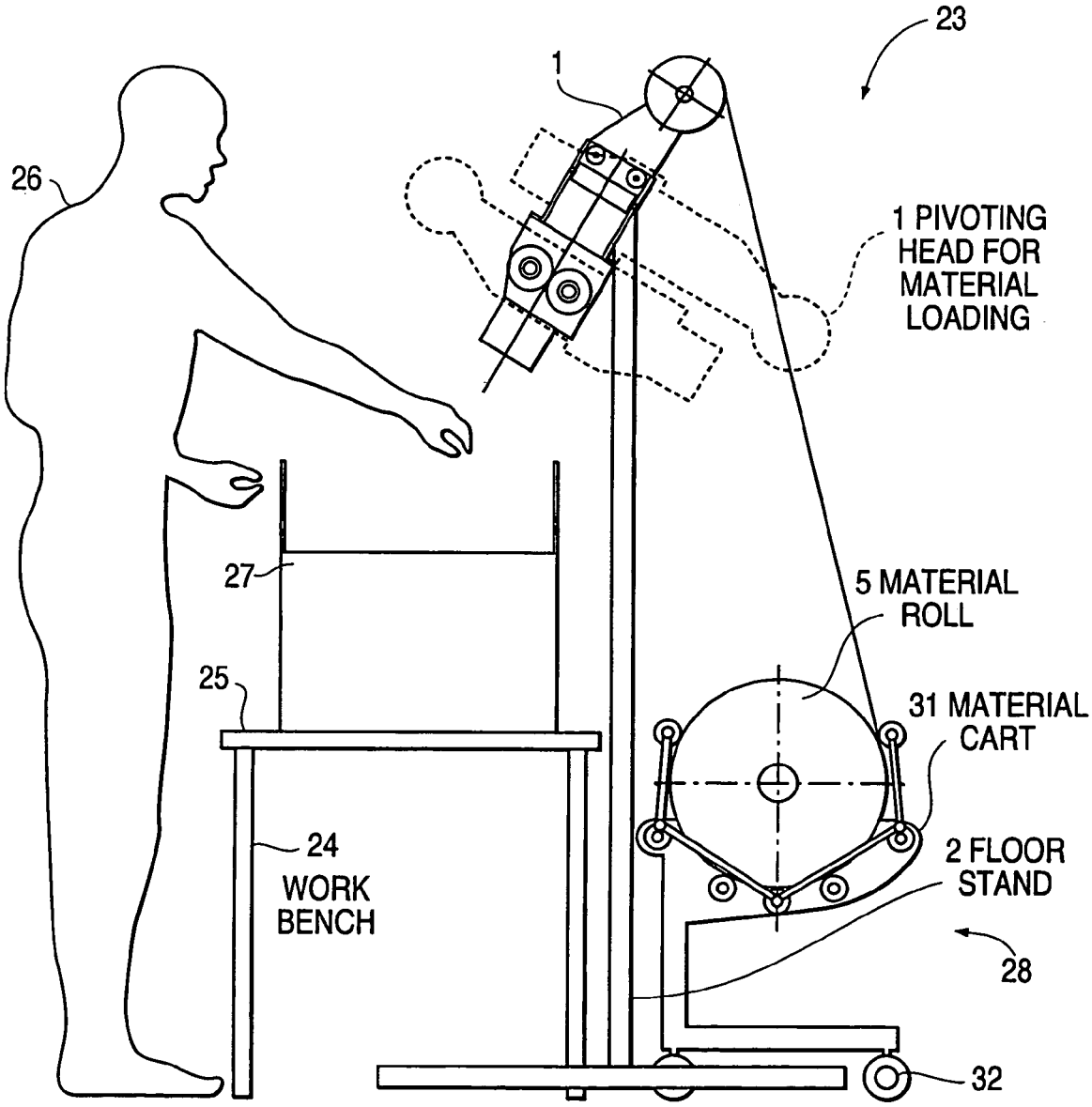
FIG. 6 is a right side view of an example embodiment of a system of Applicant's prior related applications which includes the compact apparatus of FIGS. 1-5 mounted on a floor stand located behind a work bench with a material cart with automatic roll tensioner supporting a material roll supplying paper to the apparatus, the present invention being an improvement of this system.

A system 23 as disclosed in Applicant's prior related applications, for which the present invention is an improvement, for creating and dispensing material for use as void fill and cushioning dunnage is shown in FIG. 6. The system includes, in combination, the compact apparatus 1 and a stand 2 on which the compact apparatus is mounted. The system 23 further comprises a work bench 24 providing a work surface 25 for an operator 26 for moving pillow-like shaped material 15 from the apparatus 1 and inserting it into the box 27 containing an item to be shipped. The system 23 of FIG. 6 further comprises a roll support 28 which rotatably supports the paper roll 5 from which the material can be unwound by being pulled by the feed rollers 6 and 7 of the compact apparatus 1 for supply to the compact apparatus. The roll support 28 in the system 23 in FIG. 6 is in the form of a material cart 31 with wheels 32 and a roll tensioner.

The sheet stock material, roll of paper 5, typically has an initial width of 24 to 34 inches. After the edges are folded by the conversion assembly of the apparatus, the width of the pillow-shaped product is reduced to 7-8 inches, for example, with the continuous strip being perforated at 17 on each side every 7 inches, for example. The apparatus and dunnage product could, of course, be dimensioned for producing other sizes of cushioning product.

In use, the operator manually feeds the paper or other material from the supply roll 5 located in the vicinity of the compact apparatus 1 by pressing a feed switch 68 on controller 69, FIG. 1, until the paper extends from exit chute 21 at the front of the unit 1. The operator presses on a foot switch, not shown, to begin dispensing paper. As paper moves through the inside of the unit 1, the paper is folded and formed into pillow-like shapes for use as cushioning dunnage. The formed material is uniformly perforated on each side edge every 7 inches at 17 in the example embodiment. When a desired length of the cushioning product is reached, the operator releases the foot switch to stop dispensing cushioning product. The operator rips the cushioning product from the unit at a desired perforation line and places the product in the box 27 to use for void-fill or cushioning.

The compact apparatus and system is advantageously affordable and practical for customers whose packing needs can be met with a single unit that doesn't take up a lot of space. It also can flexibly serve the needs of customers with high-speed and high-volume production lines where multiple, stand alone packing stations and/or centralized packing stations are utilized. Raised flexible installation configuration options, which can be installed over or under work benches, and over or under conveyor lines, are also possible. Multi-directional pivoting of the unit 1 on the stand/material cart is for ease of loading the paper material 8 in unit 1. Because perforation is achieved in the paper material on-site and in real-time, pre-perforated paper need not be provided on a roll.

Another compact apparatus 71 disclosed in the aforementioned related applications, for which the present invention is an improvement, is partially illustrated in FIGS. 8-11D. The apparatus 71 is like that in FIGS. 1-5, and useable in systems as in FIG. 6, with the difference that instead of using perforator gears 18 and 19 as in compact apparatus 1, the apparatus 71 comprises cooperating feed rollers 72 and 73 wherein at least one of the feed rollers is a rotary cutting die. In the example embodiment only one of the feed rollers, 72, is a rotary cutting die having a plurality of cutting blades 74 on its surface for cutting slits 86 in material at spaced locations along the length of the material as the material is fed through the apparatus to allow an operator to rip from the apparatus a desired length of cushioning product being dispensed by the apparatus, see the length 75 ripped from the material as shown schematically in FIG. 11D.

The feed roller 73 has a smooth, annular surface so that it acts as an anvil against which the material being fed between the rollers can be cut by the blades 74 on roller 72. The rollers are driven by motor 76 through transmission 77 under the control of controller 78, the operation of which is like that described in reference to the embodiment of FIGS. 1-5 and the system of FIG. 6. The input rollers 11-14 and material shaping roller 9 shown in FIGS. 1-5 are also used in the compact apparatus 71 although not shown in FIGS. 8-11D for simplicity.

Figure 8:
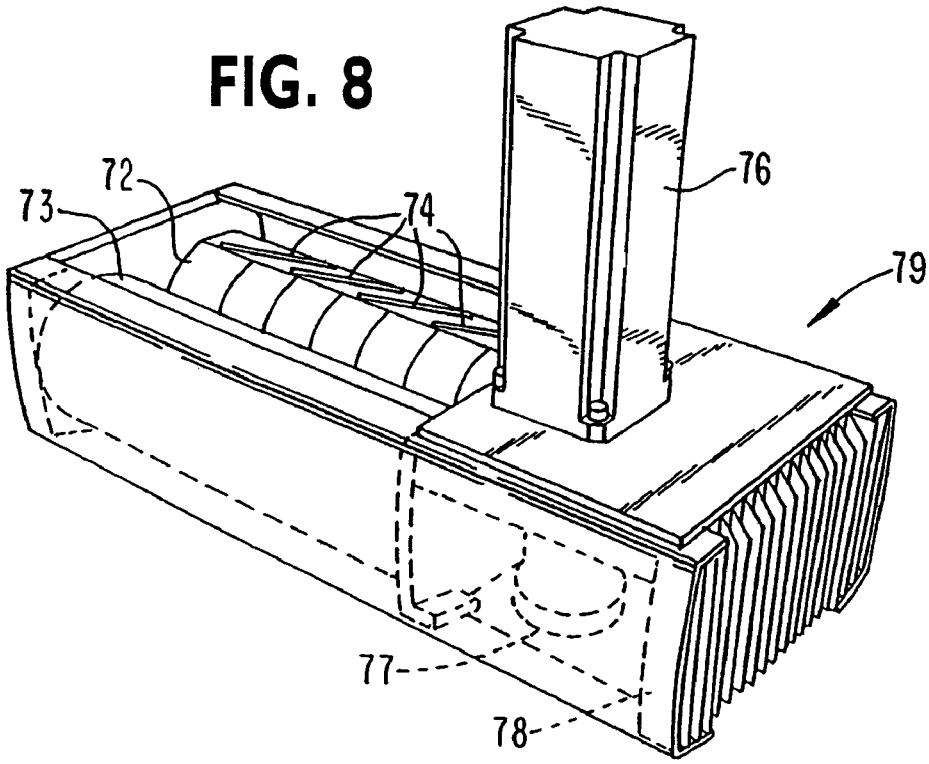
FIG. 8 is a perspective view from the front right and somewhat above a rotary die cut assembly of another embodiment of a compact apparatus of Applicant's aforementioned prior related applications for creating and dispensing material for use as void fill and cushioning dunnage, for which the present invention is an improvement.
Figure 9:
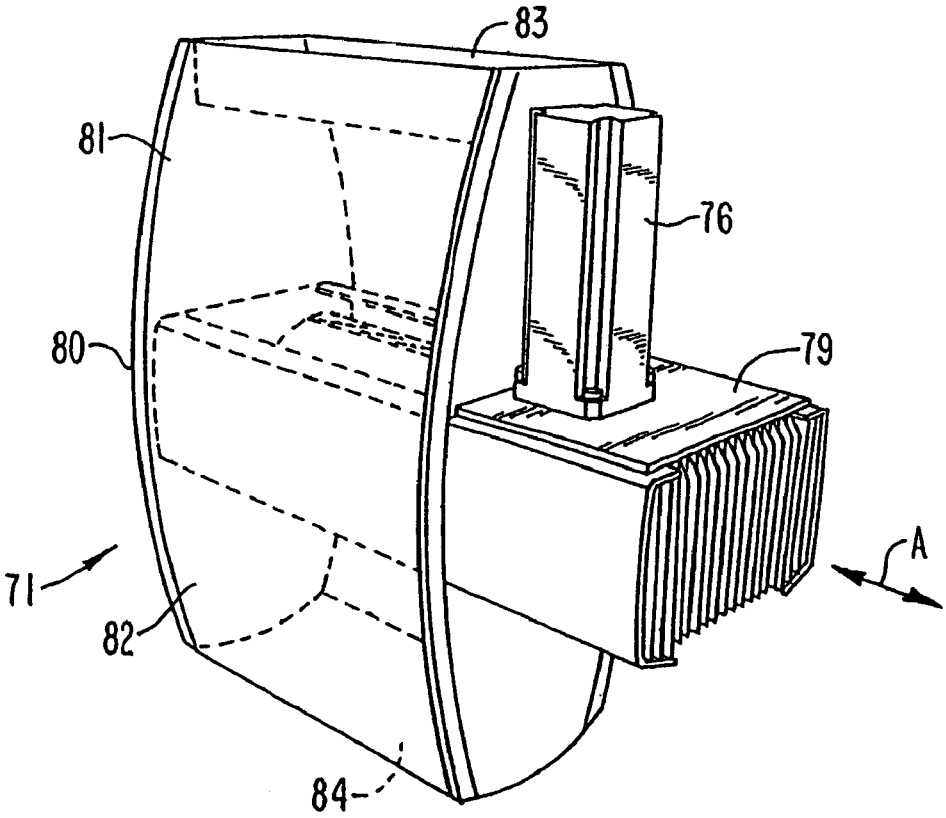
FIG. 9 is a perspective view from the front right of the rotary die cut assembly of FIG. 8 removably installed as a unit in a cavity of a housing of the compact apparatus defining input and output chutes for material fed through the apparatus, the apparatus otherwise being like that shown in FIGS. 1-5, and useable in a system shown in FIG. 6, for example, the present invention being an improvement of this system.
Figure 10A:
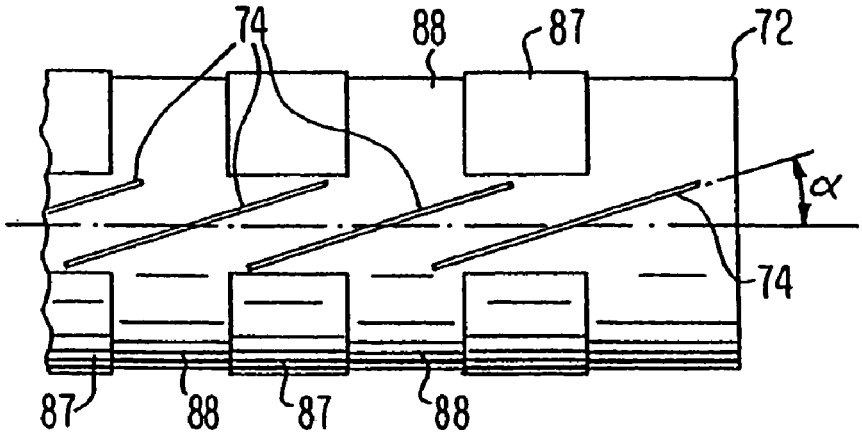
FIG. 10A is a top view of the right side of a feeding roller of the die cut assembly of FIGS. 8 and 9, the feeding roller being a rotary cutting die having a plurality of cutting blades on its surface.
Figure 10B:
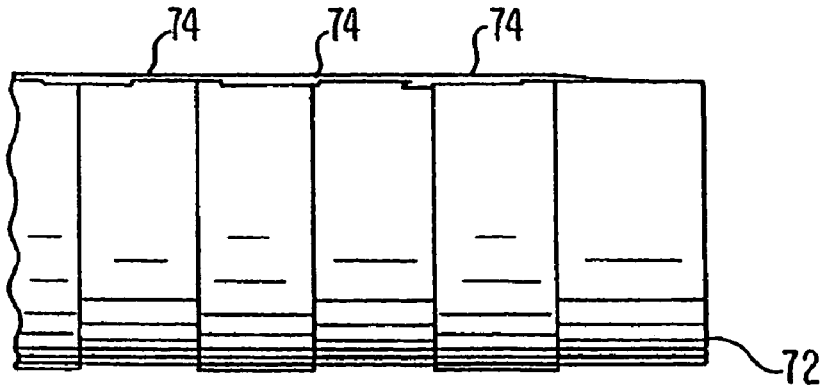
FIG. 10B is a front side view of the feeding roller which also serves as a rotary cutting die as seen from below the roller in FIG. 10A.
Figure 10C:
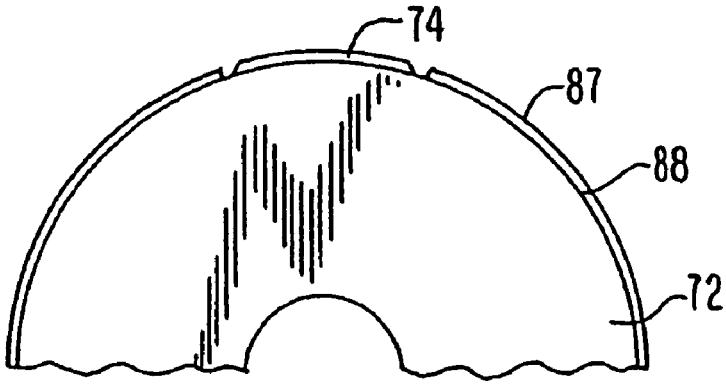
FIG. 10C is a partial end view of the feeding roller/rotary cutting die as seen from the right end of the roller in FIG. 10B.
Figure 11A:
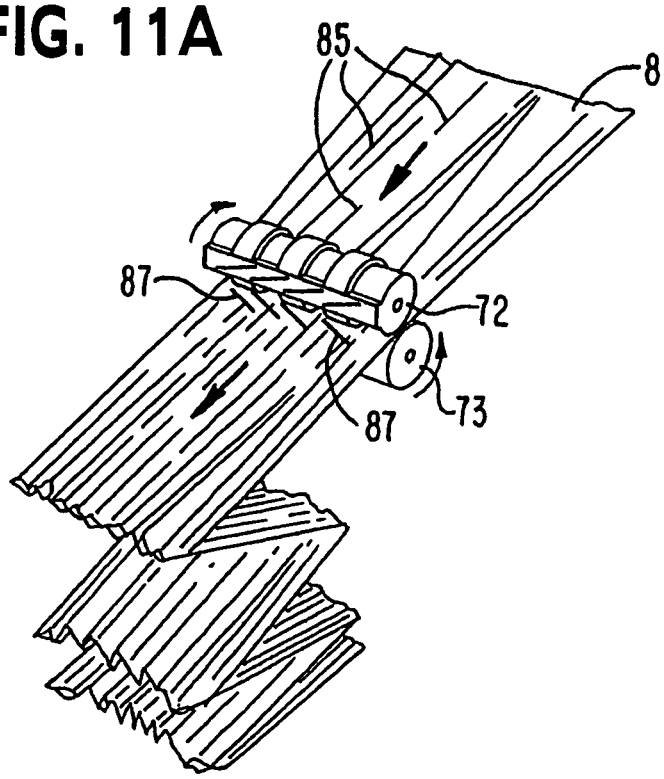
FIG. 11A is a schematic representation in perspective of the feed rollers of the apparatus of FIGS. 8-10C showing the continuous strip of material, shaped with its width reduced to form longitudinally extending convolutions across the width of the material with angled slits formed therein by the rotary cutting die of the material feeding arrangement, the material being folded on itself downstream of the feeding roller by a hinge effect at the spaced locations of the slits along the length of the material.
Figure 11B:
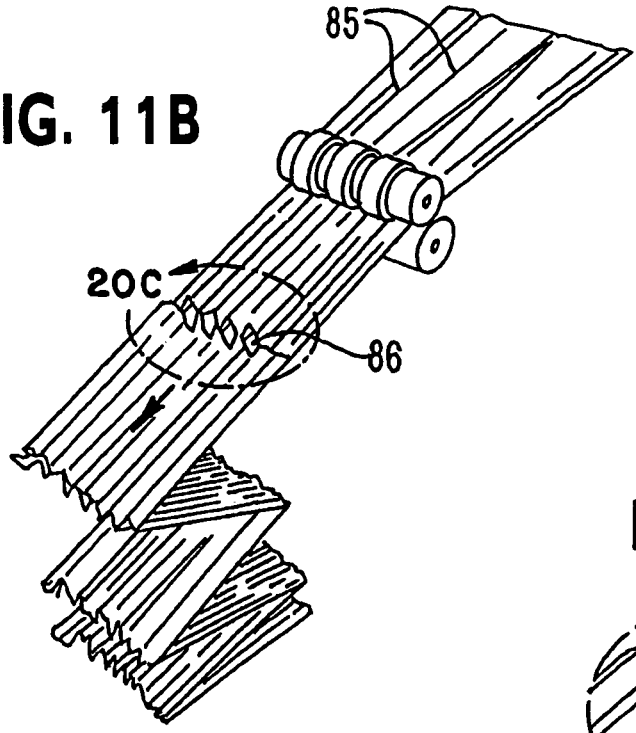
FIG. 11B is a schematic, perspective view similar to FIG. 11A and showing in more detail the opening of the slits through random convolution of the material into an irregular honeycomb-like structure during separation of the material.
Figure 11C:
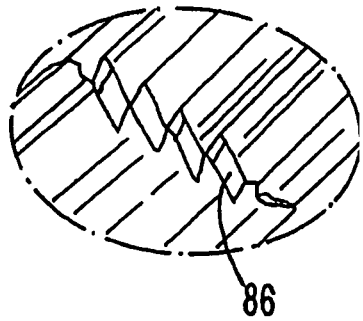
FIG. 11C is an enlarged view of the irregular honeycomb-like structure within the circle 11C in FIG. 11B.
Figure 11D:
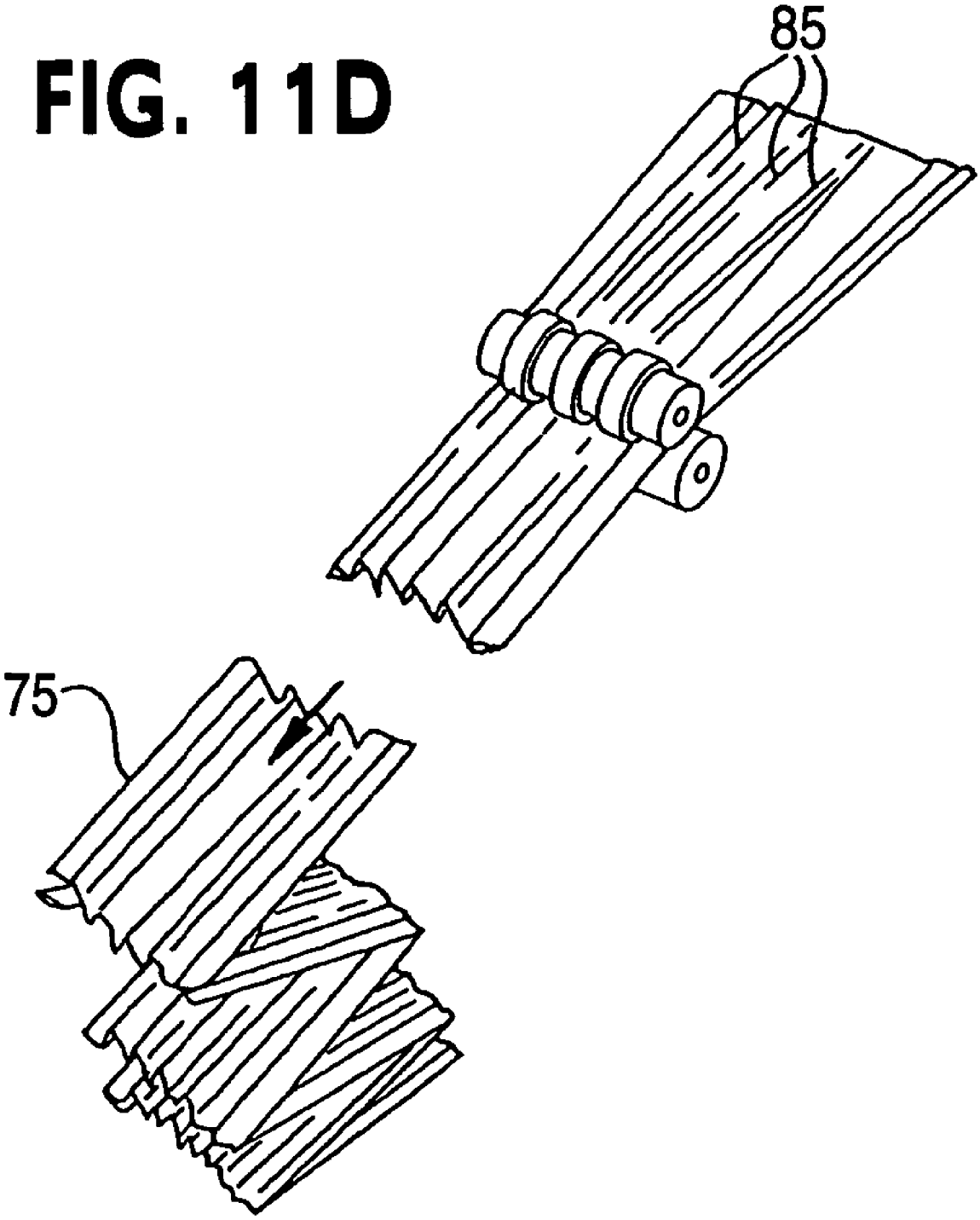
FIG. 11D is another schematic, perspective view like FIGS. 11A and 11B showing a separated length of material ripped from the strip by the operator in the direction of the arrow.

The rotary cutting die assembly, 79 in FIG. 8, is a unit which can be removably installed in the open-ended chute structure 80 of the apparatus 71 in the direction of arrow A as depicted in FIG. 9 from either side of the apparatus. The structure 80 forms input and output chutes 81 and 82, respectively, leading to and from the cooperating feed rollers in the compact apparatus through respective openings 83 and 84. The cutting blades 74 on the rotary cutting die/feed roller 72 are arranged at an angle $\alpha$ to the roller axis B-B as shown in FIG. 19A. The angle $\alpha$ is 18° in the example embodiment, but could be another angle, although preferably $\alpha$ is within the range of 10° and 80° for the reasons discussed below. The blades are embedded in the roller surface with their outer cutting edges protruding from the roller surface and following the roller circumference as seen in FIGS. 10B and 10C. The smooth surfaced feed roller 73 is formed of an ultrahigh molecular weight plastic. The roller has a diameter slightly different from roller 72 for even wear. The material 8 fed between the rollers 72 and 73 is pinched between the opposed surface of the rotatably driven rollers for feeding and cutting slits in the material.

The plurality of shaping rollers upstream of the rotary cutting die assembly 79 are preferably dimensioned and adjusted to reduce the width of the material so that random convolutions 85 are formed in the material across the width of the material. This is done without folding back the edges of the material as in the product of FIGS. 7A-7C. The rollers are rotatably mounted so as to move with the contacting strip of material thereby minimizing sliding contact and friction. The material, including these convolutions are slit by the rotary cutting die. This feature, together with the angle of slits 86 cut into the material convolutions, results in a cushioning product in which separation of the material starts with the expansion of the slits through the random convolutions of the paper or other material into an irregular honeycomb-like structure 86, see FIGS. 11B and 11C. Separation of the material is completed with the fracture of the honeycomb structure to provide a length 75 of the material, FIG. 11D, upon ripping by the operator.

The feed roller/rotary cutting die 72 has a circumferential surface with annular portions 87 and 88 of relatively larger and relatively smaller diameter spaced along the roller axis B-B. The cutting blades 74 are located intermediate the axial ends of the roller and circumferentially between the opposite ends of the relatively larger diameter annular portions 87 as seen in FIG. 10A. The void fill and cushioning dunnage produced by the compact apparatus 71 advantageously exhibits a hinge effect at each slit area along its length as it is fed from the apparatus so that the material readily folds on itself during dispensing as shown at 87 in FIGS. 11A-11C. It has been found that this helps rapidly fill voids in packages with little effort by the operator once the filling process is started. The slits also enable quick ripping of a length of the material from the continuous strip once the package has been filled.

Figure 12:
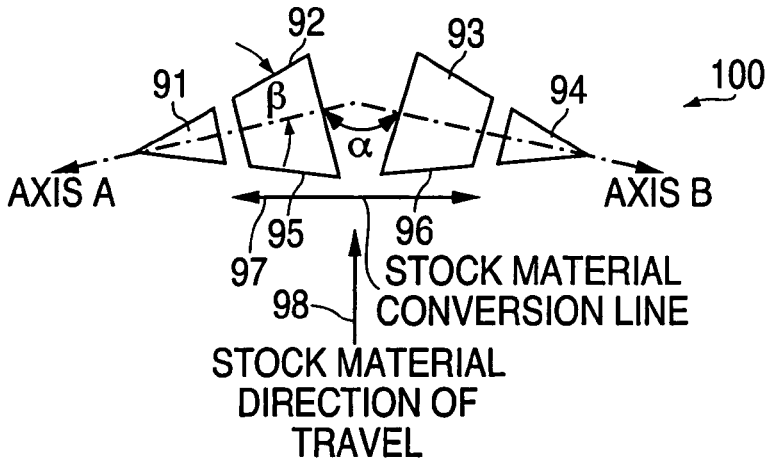
FIG. 12 is a schematic illustration of convex roller assembly of the present invention comprising four independently rotatable rollers on two axes for use as a constant-entry, material shaping apparatus in lieu of the single convex roller in each of the compact apparatus of FIGS. 1-5 and FIGS. 8-11D and the system of FIG. 6.
Figure 17:
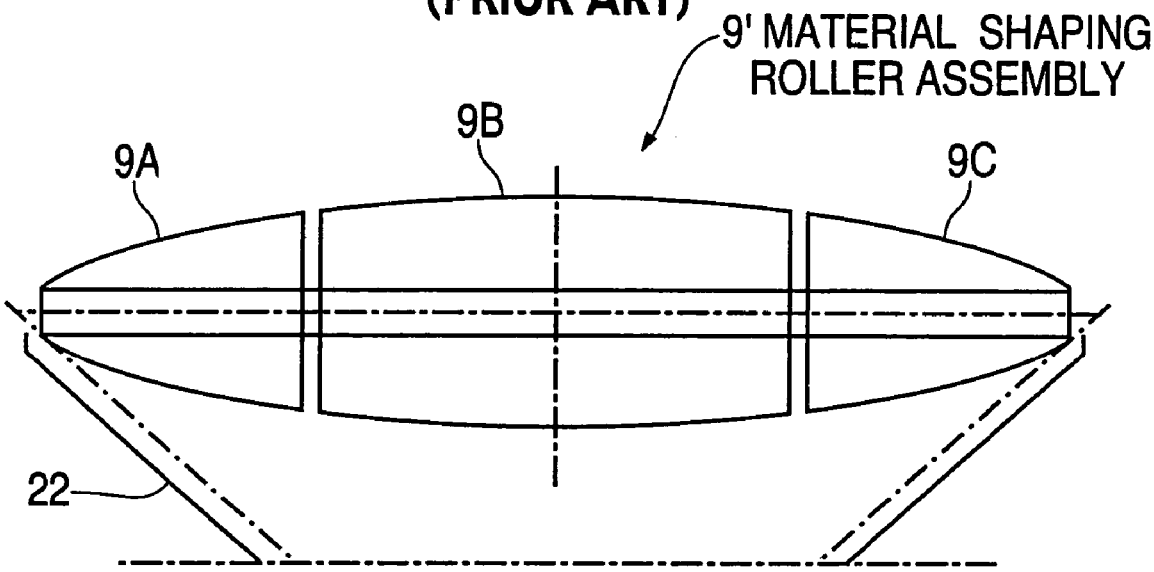
FIG. 17 (PRIOR ART)
FIG. 17 is a front side view of a prior art, convex material shaping roller assembly used by applicant in a cushioning conversion system in place of the single convex roller as shown in FIGS. 1-6, the roller assembly comprising three coaxial, independently rotatable rollers for reducing friction.

The compact apparatus and system of the present invention are preferably like those of FIGS. 1-11D except that the conversion assembly of the compact apparatus and system is changed. In place of the single convex material shaping roller 9, or the segmented convex roller assembly 9' of FIG. 17 as discussed above, in order to provide more precise and consistent control of alignment of the longitudinal center line of the sheet stock material with the center line of the material shaping structure while reducing the width of the sheet stock material and redirecting the direction of travel of the material during conversion as the material travels through the system, a material shaping assembly is employed which presents material engaging surfaces on an imaginary material conversion line transverse to the downstream direction of travel of the sheet stock material where the sheet stock material first engages the material shaping assembly. As schematically illustrated in FIG. 12, the material shaping assembly 100 comprises four tapered, independently rotatable rollers 91-94 on two axes, axis A and axis B, for engaging and shaping sheet stock material traveling over the rollers.

Figure 14A:
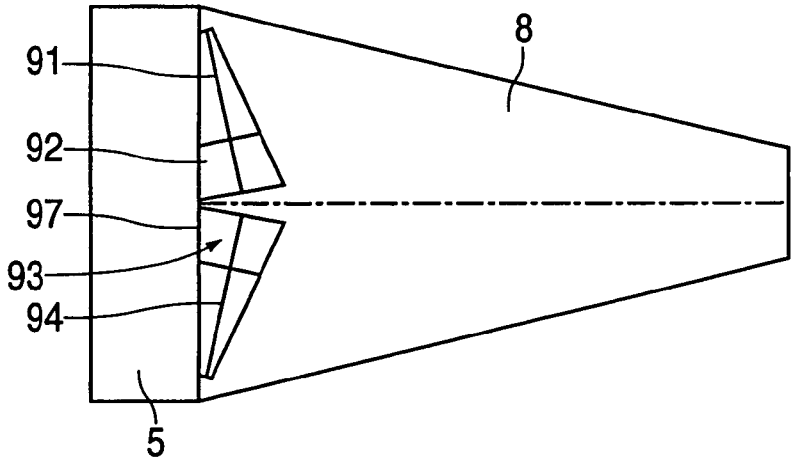
FIG. 14A is a top view of the convex roller assembly of FIG. 12 showing the axes of rollers of the assembly in relation to the roll of stock material and the traveling stock material.

The rollers 92 and 93 have their first, inner ends in spaced relation end to end for rotation about their respective axes A and B. The axes A and B are arranged at an obtuse angle $\alpha$, FIG. 12, preferably 160-170° in the example embodiment, whose aspect faces a circumferential side of the rollers, the lower side in FIG. 12, the left side in FIGS. 14A and 14B, that first engages sheet stock material traveling over the rollers. The rollers 92 and 93 taper, at an angle $\beta$ of 5-10° to their axis in the example embodiment, to second, outer ends thereof and present on said circumferential side stock material engaging surfaces 95 and 96 on an imaginary material conversion line 97 transverse to the downstream direction of travel 98 of the sheet stock material 8 from a roll 5 of material supported by the stock supply assembly, e.g. roll material cart 31 in FIG. 6. The material engaging surfaces 95 and 96 on the imaginary material conversion line 97 are located on the circumference of the material shaping assembly 100, at location 101 in FIG. 14B, where the stock material first engages the first and second rollers 92 and 93 when traveling over the rollers.

The additional tapered rollers 91 and 94 are supported for rotation about respective ones of axes A and B adjacent the second, outer ends of rollers 92 and 93. The rollers 91 and 94 are tapered end to end to provide a continuation of the tapering of their adjacent, coaxial roller as shown more clearly in FIG. 14A. The taper is straight or linear in rollers 91-94 and rollers 91 and 94 also present material engaging surfaces on the imaginary material conversion line at location 101 where the stock material first engages the rollers. In the example embodiment the imaginary material conversion line 97 is a straight line parallel to the roll of sheet stock material 5 supported by the roll support and perpendicular to the direction of travel of the stock material.

Figure 15:
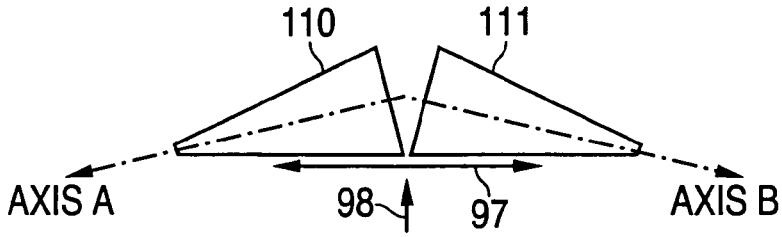
FIG. 15 is a schematic illustration of a convex roller assembly of the invention employing two independently rotatable rollers on respective oblique axes.
Figure 16A:
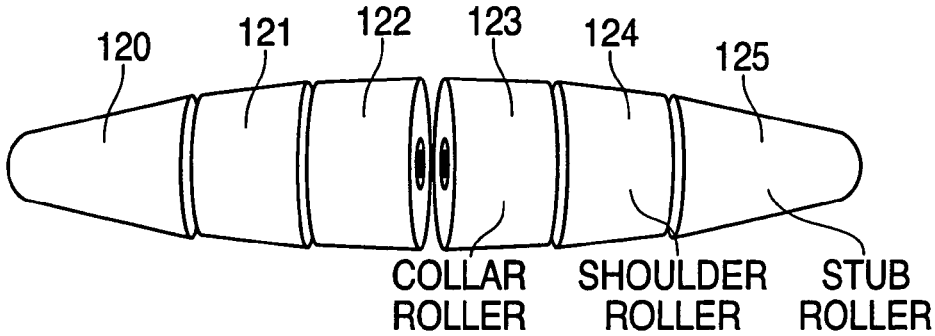
FIG. 16A is a back side view of another form of the convex roller assembly of the invention wherein three independent rollers are located on each of the two axes of the roller assembly.
Figure 16B:
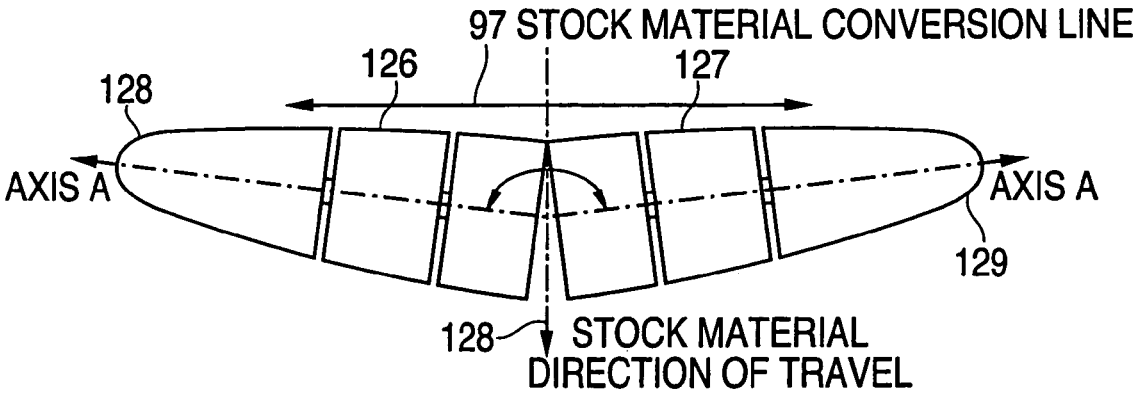
FIG. 16B is a top view of the roller assembly of FIG. 16A with a stock material conversion line being shown adjacent portions of the convex rollers located on the conversion line.
Figure 16C:
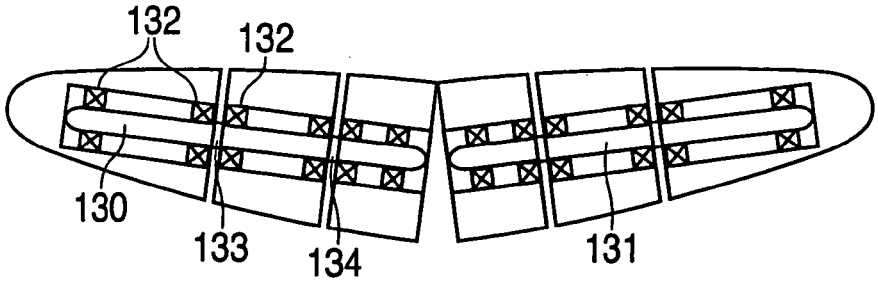
FIG. 16C is a top view of the convex roller assembly of FIGS. 16A and 16B wherein the mounting arrangement for each of the independently rotatable rollers on the two axes of the assembly is shown.

The number of rollers on each of axes A and B can be other than two as in the embodiment of FIGS. 12-14C. A single roller, 110 and 111, on each axis can be employed as depicted in FIG. 15 or more than two rollers could be used. The embodiment in FIGS. 16*a*-16*c* has three rollers, 120-125, on each axis. The taper can also be other than linear, e.g. curvilinear with the radius of curvature being relatively large, preferably at least 7 inches at the central portion of the assembly, to present material engaging surfaces 126 and 127 on each side of the centerline 128 of the material shaping assembly on the stock material conversion line 97 where the sheet stock material first engages the rollers in traveling downstream from the roll 5.

The ends 128 and 129 of the outer rollers are free ends as the support shafts 130 and 131 for the rollers and bearings 132 are internal to the roller ends with the shafts being supported on a frame of the compact apparatus at locations 133 and 134 intermediate the rollers. This permits the sheet stock material, which is wider than the roller assembly, to be smoothly shaped over the roller assembly side to side reducing the width of the initially flat sheet stock material unwound from the cylindrical roll 5 as it travels over the roller assembly. The free ends are dome-shaped in the embodiment of FIGS. 16A-16C but could be tapered to a point FIG. 12, or truncated as in FIG. 15.

Figure 13:
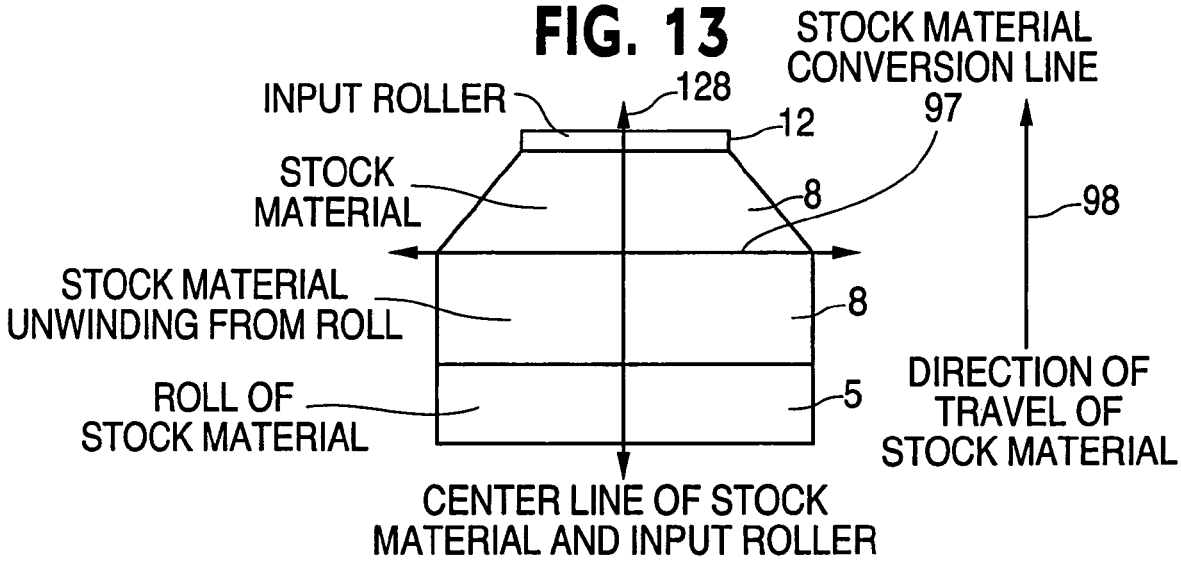
FIG. 13 is a schematic illustration of the convex roller assembly of FIG. 12 in use in a system as in FIG. 6.
Figure 14B:
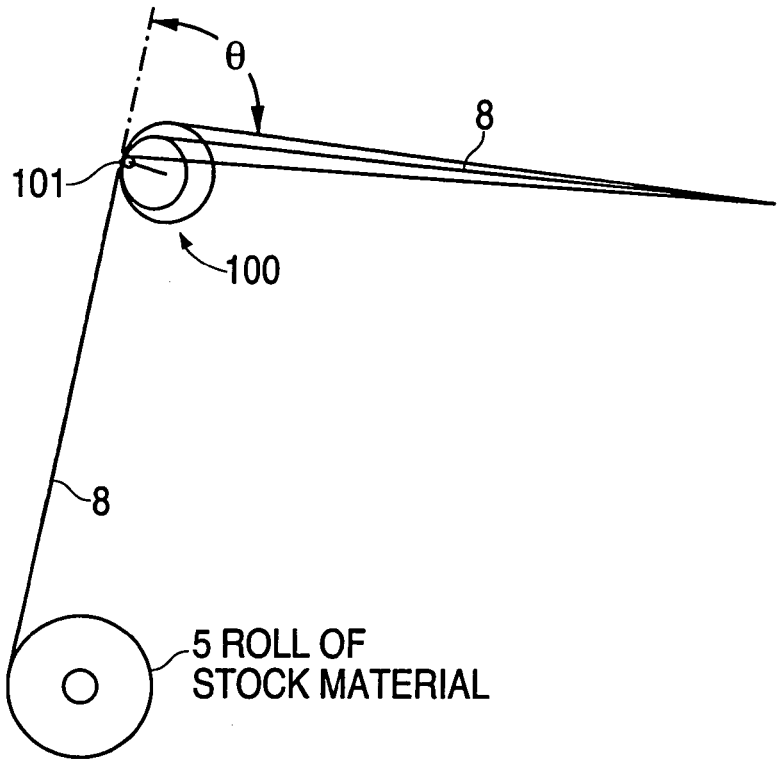
FIG. 14B is a side view of the convex roller assembly of FIG. 14A shown in relation to the roll of stock material and the direction of travel of the stock material from the roll to the convex roller assembly and from the convex roller assembly to downstream input rollers of the conversion assembly of a system like that in FIG. 6.
Figure 14C:
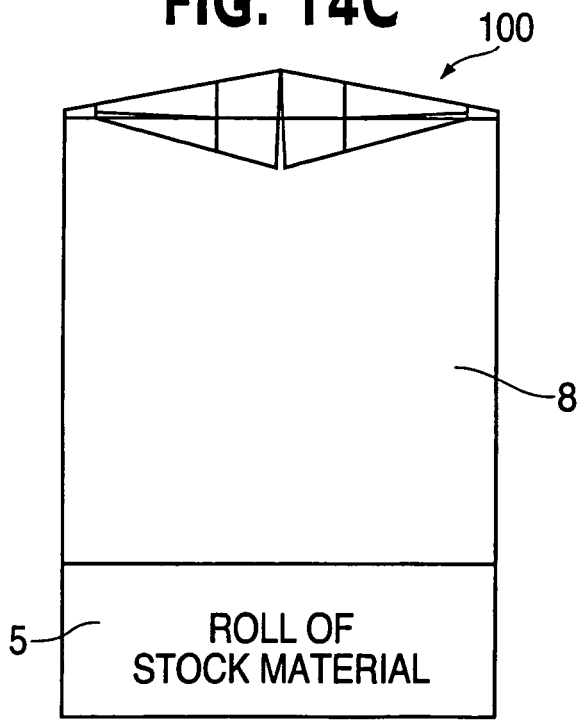
FIG. 14C is a back view of the convex roller assembly taken from the right side of FIG. 14A.

In use, as shown in FIGS. 13-14C, sheet stock material in the system is unwound from the roll 5 in the roll support and drawn over the material shaping assembly 100 which changes its direction of travel and reduces its width enroute to the input rollers 12 of the conversion assembly. The change in direction, angle $\Theta$, FIG. 14B, is preferably at least 30° in traveling over the rollers, and is approximately 100° in the example embodiment. The roller assembly maintains alignment of the longitudinal center line of the sheet stock material with the center line of the material shaping assembly during this shaping, e.g. reduction in width of the material. In the example embodiments the width of the roller assembly is preferably 12-16 inches, which is less than the width of the sheet stock material, which may be 24-34 inches, for example. The largest diameter of the rollers can be 2-4 inches, for example, at the center line of the assembly and the spacing between rollers 0.050 inch. for example, but other dimensions and configurations could be employed.

While I have shown and described only several example embodiments in accordance with the present invention, it is understood that various changes and modifications can be made therein by the skilled artisan without departing from the invention. Therefore, I do not wish to be limited to specific example embodiments disclosed herein, but intend to cover such variations as are encompassed by the scope of the appended claims.

I claim:

1. In a method of producing a cushioning product comprising drawing sheet stock material from a supply of sheet stock material through a conversion assembly to convert the sheet stock material into a three-dimensional cushioning product as the material travels therethrough, the improvement comprising redirecting and shaping the traveling sheet stock material with a convex roller assembly including a plurality of tapered rollers independently rotatable about each of respective ones of two axes arranged at an obtuse angle whose aspect faces a circumferential side of the rollers presenting sheet stock material engaging surfaces on an imaginary conversion line transverse to a direction of travel of the sheet stock material at a location where the material first engages the tapered rollers, wherein ends of the outer rollers of the convex roller assembly are free ends with the rollers being supported intermediate the rollers to permit the sheet stock material to be smoothly shaped over ends of the the roller assembly side by side reducing the width of the sheet shock material traveling over the roller assembly.

* * * * *